United States Patent [19]

Tackett et al.

[11] Patent Number: 4,846,911

[45] Date of Patent: Jul. 11, 1989

[54] PRELOADED COMPOSITE ELECTROMAGNETIC BARREL AND PROCESS FOR FABRICATING SAME

[75] Inventors: E. Wayne Tackett; Daniel C. Dombrowski, both of Logan; Scott W. Lauritzen, Hyrum, all of Utah

[73] Assignee: Morton Thiokol, Inc., Chicago, Ill.

[21] Appl. No.: 144,308

[22] Filed: Jan. 14, 1988

[51] Int. Cl.[4] ..... B65H 81/00

[52] U.S. Cl. ..... 156/173; 29/1.11; 29/446; 89/8; 89/15; 156/172

[58] Field of Search ..... 29/1.1, 1.11, 446; 89/8, 15; 156/171, 172, 173

[56] References Cited

U.S. PATENT DOCUMENTS 2,453,522 11/1948 Mart ..... 29/446
3,616,521 11/1971 Boggio ..... 29/446

OTHER PUBLICATIONS

Peterson et al, "Design and Testing of High-Pressure Railguns and Projectiles," IEEE Transactions on Magnetics, vol. MAG. 20, No. 2, Mar. 1984, pp. 252-255.
Davidson et al, "Predicting Bore Deformations and Launcher Stress in Railguns", 3rd Symposium on Electromagnetic Launch Technology, Apr. 1986.

*Primary Examiner*—Stephen C. Bentley
*Attorney, Agent, or Firm*—James C. Simmons; Gerald K. White

[57] ABSTRACT

A composite electromagnetic barrel is preloaded to minimize rail separation by jacking the rails radially outwardly away from each other and wedging a pair of insulating members between the rails to retain the preload. The jacking force is then released.

4 Claims, 2 Drawing Sheets

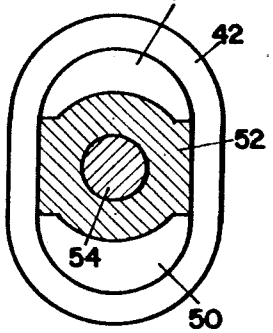
Fig. 3
Fig. 4
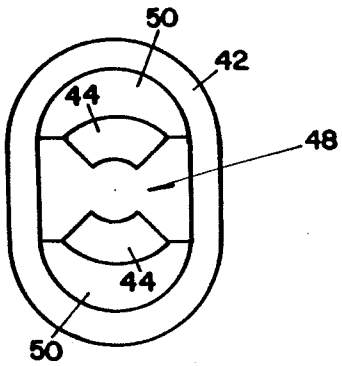
Fig. 5
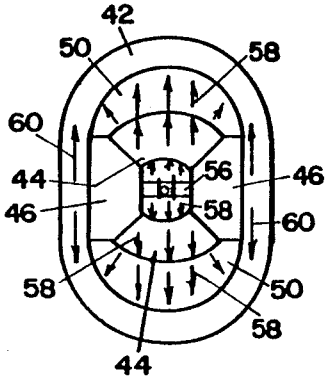
Fig. 6
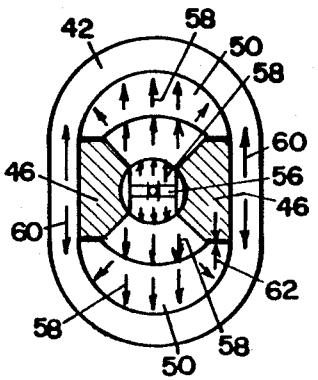
Fig. 7
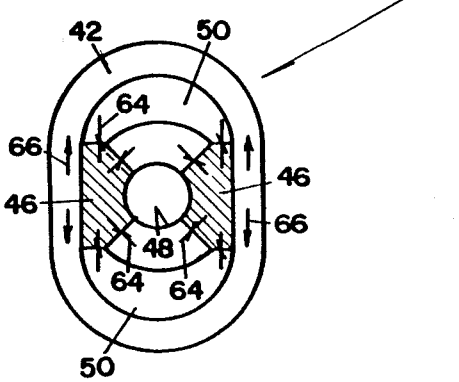
Fig. 8

PRELOADED COMPOSITE ELECTROMAGNETIC BARREL AND PROCESS FOR FABRICATING SAME

The present invention relates generally to electromagentic barrels such as may be used for electromechanical gun propulsion systems for anti-armor, anti-ballistic, or anti-aircraft applications. More particularly, the present invention relates to an electromagnetic barrel wherein the shell thereof, i.e., the barrel support structure, is composed of a composite of resin impregnated filamentary material.

In an electromagnetic barrel or railgun, a projectile is shot therefrom by means of electromagnetic forces which are generated by the use of an electric current which passes through a circuit comprising a pair of electrically conductive rails connected by an armature. An electromagnetic field is generated by the electric current in the rails which opposes the field in the armature and which thus causes the armature to accelerate outwardly toward the barrel end pushing the projectile ahead of it. The armature can become plasmatic during this process resulting in a plasma pressure behind the projectile.

Barrel weight is a major consideration for military use, especially for mobile or portable application. Metal barrel support structure weight may account for a significant portion of the total vehicle weight. For this reason, the use of high strength and stiffness lightweight composite materials for the barrel structure or shell is considered desirable.

A requirement for a railgun barrel structure is that it hold the rail and insulator assembly together during the projectile acceleration period when large bore loads are present. Bore loads comprise the magnetic forces generated by the field between the conductive rails and the pressure of the plasma behind the projectile. Structural stiffness to resist excess rail and side insulator deflection is thus a requirement of the barrel support structure. Excess deflection can result in armature disengagement, projectile impingement, and severe rail and insulator erosion.

Attempts have been made to use composite material for electromagnetic gun barrel application. A major problem has been the control of excess rail deflection. High radial stiffness or rigidity in the barrel support structure is required to control rail deflection during gun operation. Although composite materials have better stiffness-to-weight characteristics than metals, the high stiffness properties of filament wound composites are apparent in the plane of the fibers. Little stiffness, however, is apparent transverse or normal to the fiber direction. Thus, little radial stiffness is apparent in a filament wound shell structure.

To overcome this weakness, attempts have been made to control deflections by providing a preload between the composite support structure and the rail-/insulator assembly. Winding over the rail/insulator assembly using high fiber winding tension results in little preload remaining after the structure is cured and involves a complicated fabrication process of filament winding using the actual rail/insulator assembly as the mandrel.

A process of hydraulically pressurizing a pressure chamber between the composite barrel support tube and the rail/insulator assembly is complex, costly, and susceptible to leakage and preload loss.

It is, therefore, an object of the present invention to provide a process for fabricating a preloaded composite electromagnetic barrel which has sufficient structural stiffness to resist excess rail and side insulator deflection.

It is another object of the present invention to provide such a process for fabricating a composite electromagnetic barrel which is inexpensive, not complicated, and not susceptible to leakage and preload loss.

It is yet another object of the present invention to provide a composite electromagnetic barrel wherein the composite shell has good strength capability so that minimal rail deflection occurs during gun firing.

It is still another object of the present invention to provide such a composite electromagnetic barrel which is rugged, reliable, inexpensive, and not susceptible to leakage and preload loss.

The above and other objects, features, and advantages of this invention will be apparent in the following detailed description of the preferred embodiments thereof which is to be read in connection with the accompanying drawings.

IN THE DRAWINGS

FIGS. 3 to 8 are schematic views, taken in a radial plane, illustrating a process for fabricating a composite electromagnetic barrel in accordance with the present invention.

DETAILED DESCRIPTION OF THE PREFERRED EMBODIMENTS

Figure 1:
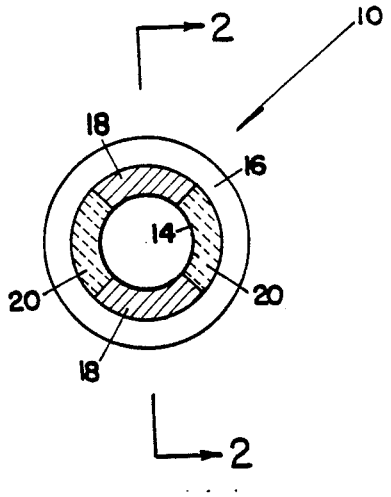
FIG. 1 is a sectional view, taken in a radial plane, of a composite electromagnetic barrel which embodies the present invention.
Figure 2:
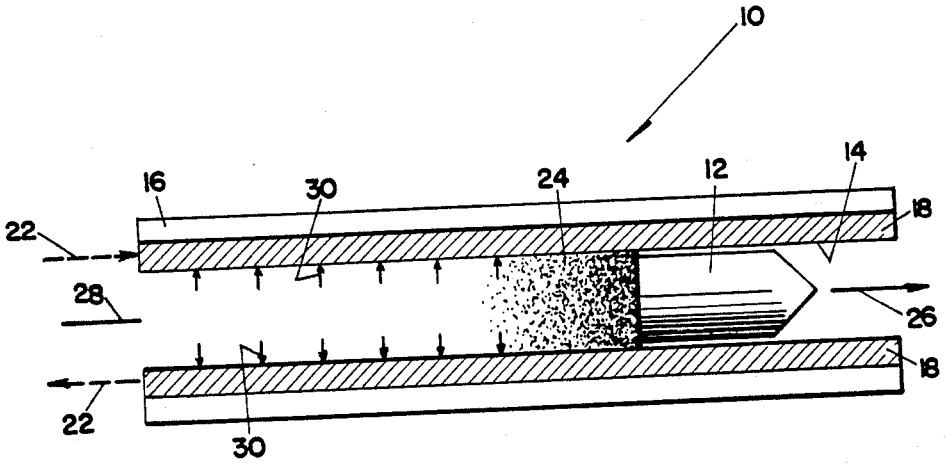
FIG. 2 is a sectional view of the barrel of FIG. 1 taken along lines 2—2 thereof.

Referring to FIGS. 1 and 2, there is shown generally at 10 a composite electromagnetic barrel for firing a projectile illustrated at 12 from the bore 14 thereof. The barrel 10 includes an elongate generally cylindrical shell 16 in which is disposed a pair of metallic or otherwise electrically conductive rails 18 on respectively opposite sides of the shell 16 so that the space between the rails defines the barrel bore 14. A pair of insulating members 20 are disposed on opposite sides respectively of the bore 14, and each of the insulating members 20 is positioned between the rails 18, as best shown in FIG. 1.

As illustrated in FIG. 2, the railgun 10 is powered by an electric current illustrated at 22 which passes through a circuit comprising the rails 18 connected by an armature which during the firing can become plasmatic, as illustrated by plasma 24. The field generated in the rails 18, which is behind the armature 24 as it accelerates outwardly toward the barrel end, opposes the field in the armature 24 to accelerate it and thus accelerate the projectile 12, as illustrated at 26. The armature 24, composed of a conductive material such as steel, remains solid up to a velocity of about 2 or 3 kilometers per second after which it becomes plasmatic. In order to prevent excess erosion of the rails 18 so that the rail gun may be used a multiple number of times without changing them, the rails 18 are preferably composed of molybdenum or other suitable erosion resistant conductive material. The insulating members 20 are preferably composed of a suitable ceramic material such as, for example, aluminum oxide. A typical railgun may be ten meters long and powered by an electric current of six million volts to provide a projectile velocity leaving the barrel in the range of 10 to 25 kilometers per second.

In order to provide a light weight electromagnetic barrel, the shell 16 is composed of a resin impregnated filamentary material. It is preferred that the filamentary material be a non-conducting light weight high stiffness material such as aramid fibers. While graphite is desirable from the standpoint of having high stiffness, it is a conductor of electricity. If a conducting filamentary material such as graphite is used, then it is necessary to dispose insulating backing members between the rails and the shell as will be described more fully hereinafter with reference to FIGS. 3 through 8. The shell 16 is filament wound preferably by interspersing low angle helical windings of about 0° to 15° relative to the barrel axis 28 for stiffness, i.e., so that the shell will not "droop", with high angle hoop direction windings of about 90° relative to the barrel axis 28 for radial strength when a preload is applied as will be described more fully hereinafter with respect to FIGS. 3 to 8. However, the particular winding angles will vary depending upon the desired shell chracteristics and can be determined using principles commonly known to those of ordinary skill in the art to which this invention pertains. As the term is used in this specification and in the claims, "radial plane" is meant to refer to a plane which is perpendicular to the barrel axis 28. As the term is used in this specification and the claims, "radial" or "radially" is meant to refer to direction toward or away from the barrel axis 28. The longitudinal direction refers to a direction along the barrel axis 28. The filamentary material may be impregnated with any suitable resin such as, for example, Fiberite 934 epoxy manufactured by Fiberite Corporation.

Excess rail and insulator deflection may result in disruptive armature disengagement, projectile impingement, and rail and insulator erosion. In order to provide increased radial stiffness of the shell 16 to resist such deflection in accordance with the present invention, the shell 16 is preloaded, as will be hereinafter described with respect to FIGS. 3 to 8. The amount of preload is preferably greater than the operational load, i.e., the magnetic separation forces illustrated at 30 and other forces tending to push the rails apart, so that the shell may remain in compression throughout the firing process. The amount of preload can be determined using principles commonly known to those of ordinary skill in the art to which this invention pertains. The preload is maintained by the insulating members 20 which are sized, in accordance with principles commonly known to those of ordinary skill in the art to which this invention pertains, to be wedged between the rails 18, as shown in FIG. 1.

Referring to FIGS. 3 to 8, there is illustrated a process for fabricating a composite electromagnetic barrel 40 which has a shell 42, rails 44, and insulating members 46 which are similar to the shell 16, rails 18, and insulating members 20 of FIGS. 1 and 2. The rails 44 and insulating members 46 are installed in the shell 42 to define a bore 48 similar to the bore 14 of barrel 10 of FIGS. 1 and 2. If the shell 42 is composed of an electrically conductive material such as carbon fibers, as previously discussed, then the rails 44 must be insulated therefrom. Thus, the barrel 40 also includes a pair of insulative backing plates 50 between the respective rails 44 and the shell 42. The backing plates 50 are preferably composed of a suitable ceramic material such as, for example, aluminum oxide.

Referring to FIG. 3, the electromagnetic barrel 40 is fabricated by suitably attaching, such as by bolting or clamping, the ceramic backing plates 50 to a suitably shaped winding mandrel 52 which includes a winding shaft 54. The mandrel 52 is preferably composed of polished steel or other material which has a positive coefficient of thermal expansion and thus allows easy removal from the shell 42 after curing.

Referring to FIG. 4, the shell 42 is filament wound about the mandrel 52 and backing plates 50, and the filament winding angles are selected as discussed with respect to FIGS. 1 and 2.

Referring to FIG. 5, after the composite shell 42 is cured, the mandrel 52 is removed therefrom and the pair of electrically conductive rails 44 are installed inwardly of the shell 42 and adjacent the backing plates 50 respectively such that the backing plates separate and insulate the respective rails from the shell and such that the rails 44 are disposed to define therebetween the central bore 48, as illustrated in FIG. 5. The rails 44 are attached to the backing plates 50 by any suitable means such as by bonding.

In order to apply a preload to the shell 42 in accordance with the present invention, a suitable separation tool such as a conventional hydraulic jack illustrated at 56 is inserted into the bore 48 and operated to jack the rails 44 and their corresponding backing plates 50 radially outwardly away from each other, as illustrated by arrows 58, so that the composite shell 42 is preloaded in tension as illustrated by arrows 60. The predetermined amount of preload is applied so that the rails 44 will remain in compression during firing of the railgun 40.

Referring to FIG. 7, the insulating members 46 are sized, in accordance with principles commonly known to those of ordinary skill in the art to which this invention pertains, to maintain the separation between the rails 44 and backing plates 50 after the jacking pressure is relieved so as to retain the preload on the shell 42. The rails 44 are separated just enough to insert the insulating members 46, leaving a small assembly tolerance gap illustrated at 62 of perhaps about 10 mils to allow for insertion of the insulating members 46.

Referring to FIG. 8, after the insulating members 46 are inserted, the jacking pressure may be released and the jacking tool 56 removed to thus leave the rails 44 and insulating members 46 under the desired compressive preload as illustrated at 64, with residual tension remaining in the shell 42, as illustrated at 66. As previously discussed, the preload 64 is preferably selected, using principles commonly known to one of ordinary skill in the art to which this invention pertains, so that the compressive stress state is greater than the expected rail separation forces during gun firing to thus allow only minimal rail deflection during gun firing.

It is to be understood that the invention is by no means limited to the specific embodiments which have been illustrated and described herein, and that various modifications thereof may indeed be made which come within the scope of the present invention as defined by the appended claims.

We claim:

1. A process for fabricating a composite electromagnetic barrel comprises the steps of:

a. Filament winding an elongate shell about a mandrel;

b. removing the mandrel;

c. installing a pair of electrically conductive rails in the shell so that they are disposed on opposite sides respectively of a central bore thereof;

d. applying a force to jack the rails radially outwardly away from each other to preload the shell;

e. wedging, while the rails are jacked radially outwardly, a pair of insulating members, on opposite sides respectively of the bore, between the rails to retain the preload on the shell; and f. releasing the force whereby a preload is retained on the shell by the pair of wedged insulating members.

2. A process as claimed in claim 1 wherein the step of applying the force comprises inserting a separation tool between the rails and operating the separation tool.

3. A process for fabricating a composite electromagnetic barrel comprises the steps of:

a. attaching a pair of elongate backing plates to opposite sides respectively of an elongate mandrel;

b. filament winding a barrel shell about the mandrel and backing plates;

c. removing the mandrel;

d. installing a pair of electrically conductive rails inwardly of the shell and adjacent the backing plates respectively such that the backing plates separate the respective rails from the shell and such that the rails are disposed to define therebetween a central bore;

e. applying a force to jack the rails radially outwardly away from each other to preload the shell;

f. wedging, while the rails are jacked radially outwardly, a pair of insulating members, on opposite sides respectively of the bore, between the rails and backing plates to retain the preload on the shell; and g. ceasing application of the force whereby a preload is retained on the shell by the pair of wedged insulating members.

4. A process as claimed in claim 3 wherein the step of applying the force comprises inserting a separation tool between the rails and operating the separation tool.

* * * * *